United States Patent [19]

Courduvelis

[11] 4,395,302

[45] Jul. 26, 1983

[54] METAL DISSOLUTION PROCESS USING $H_2O_2$—$H_2SO_4$ ETCHANT

[75] Inventor: Constantine I. Courduvelis, Orange, Conn.

[73] Assignee: Enthone Incorporated, West Haven, Conn.

[21] Appl. No.: 329,650

[22] Filed: Dec. 10, 1981

[51] Int. Cl.[3] ..... C23F 1/00; B44C 1/22; C03C 15/00; C03C 25/06

[52] U.S. Cl. ..... 156/642; 156/666; 252/79.2

[58] Field of Search ..... 156/642, 666, 345, 901, 156/902; 252/79.2, 79.4; 75/108, 109; 134/13, 10; 427/96, 98, 309

[56] References Cited

U.S. PATENT DOCUMENTS 3,400,027 9/1968 Radimer et al. ..... 156/642

OTHER PUBLICATIONS

Circuit World (GB), vol. 6, No. 1, 1979, Hydrogen Peroxide/Sulphuric Acid Etching Systems by D. C. Simpkins, pp. 54–57.

*Primary Examiner*—William A. Powell
*Attorney, Agent, or Firm*—DeLio and Libert

[57] ABSTRACT

An improved process for dissolution of metals by etching, and particularly the etching of copper in printed circuit board processing or the like, using an aqueous $H_2O_2$—$H_2SO_4$ etching solution, in which the concentration of $H_2SO_4$ in the etching solution is allowed to decrease during use of the etching solution from an initial, relatively high level at the time the etching solution is put into use, to a final, relatively low level. When a predetermined concentration of dissolved etched metal exists in the etching solution, the etching solution is removed from use, $H_2SO_4$ is added to increase the concentration of $H_2SO_4$ in the etching solution to approximately the initial, relatively high level, and the metal is precipitated out of the etching solution.

8 Claims, 1 Drawing Figure

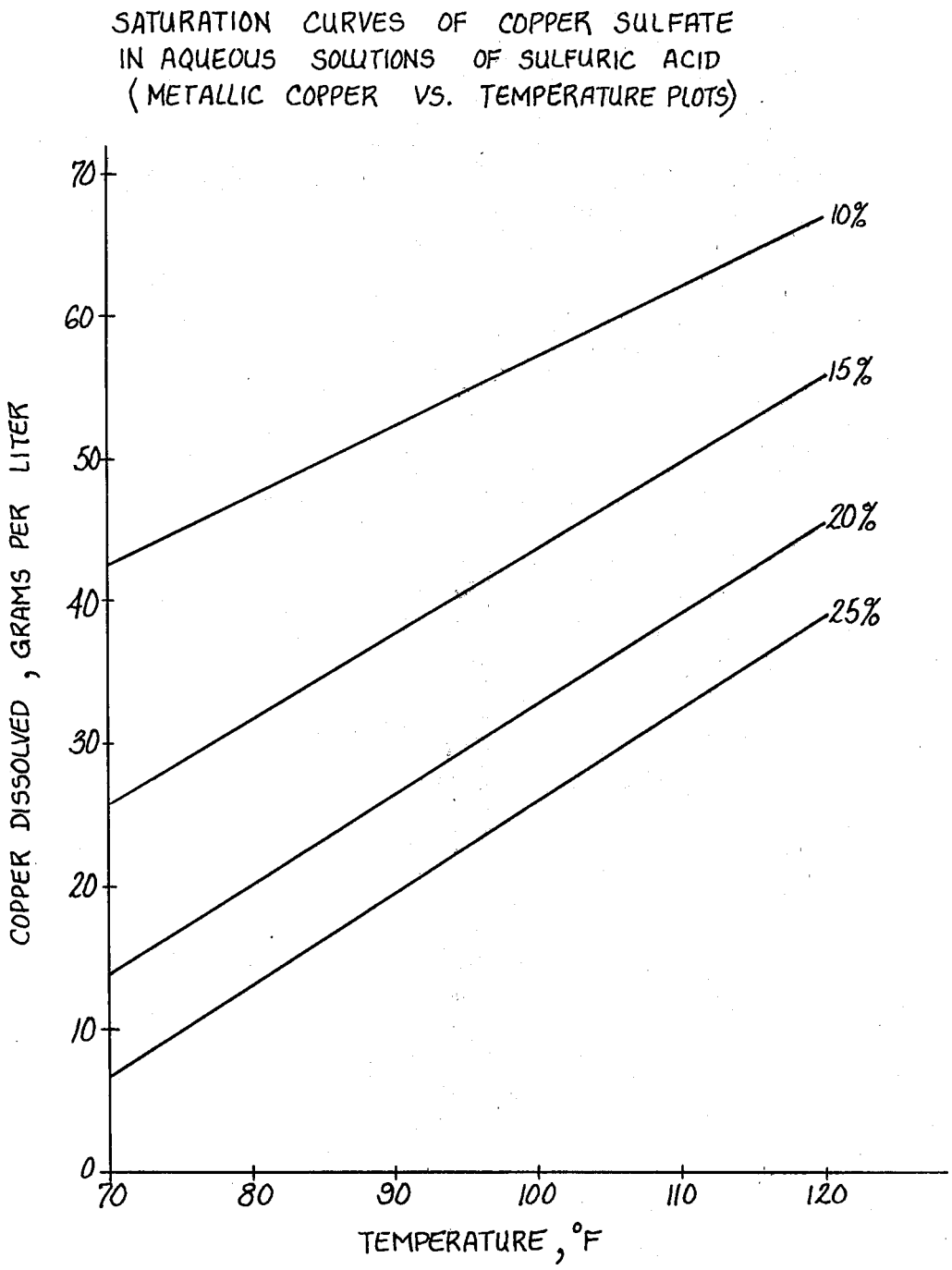
SATURATION CURVES OF COPPER SULFATE
IN AQUEOUS SOLUTIONS OF SULFURIC ACID
(METALLIC COPPER VS. TEMPERATURE PLOTS)
COPPER DISSOLVED, GRAMS PER LITER
0
10
20
30
40
50
60
70
10%
15%
20%
25%
70
80
90
100
110
120
TEMPERATURE, °F

METAL DISSOLUTION PROCESS USING $H_2O_2$—$H_2SO_4$ ETCHANT

BACKGROUND OF THE INVENTION

1. Field of the Invention

The present invention relates generally to the dissolution of metals in an aqueous bath containing hydrogen peroxide and sulfuric acid, and more particularly, relates to an improved process of etching copper in printed circuit board processing and the like.

2. Prior Art

In the manufacture of printed circuit boards, a laminate of copper and etch-resistant material, usually plastic, is used. Holes are drilled at appropriate locations on the board and the walls of the holes are metallized such as with copper to provide electrical contact between the two faces or surfaces of the board. Methods of metallization are known and include the steps of cleaning, catalyzing and electroless copper deposition.

The electroless plating or deposition of copper over the existing copper clad on the boards requires etching of the copper cladding to some degree in order to secure adhesion of the electroless copper plate on the copper clad. Two kinds of etchants are typically used commercially for this process:

(a) those based on acidic persulfate solutions; and (b) those based on hydrogen peroxide-sulfuric acid mixtures.

In the last few years, etchants based on hydrogen peroxide-sulfuric acid mixtures have become more popular because they are more economical and can be operated for a long period of time by adding acid and peroxide to regenerate the etchant. Further, waste treatment for removal of copper is not necessary since copper values can be recovered from the spent etchant with relative ease. For instance, as disclosed in U.S. Pat. No. 4,144,119, the bath or etchant is allowed to cool to room temperature to induce precipitation of copper compounds which may then be recovered by filtration. Other examples of hydrogen peroxide-sulfuric acid etchants are disclosed in U.S. Pat. Nos. 3,293,093, 4,130,455 and 4,174,253. Hydrogen peroxide-sulfuric acid etchants are usually operated at 110°-130° F. and when the etchant becomes saturated or approaches saturation with copper, or some other condition such as substantially decreased etch rate, etc. exists, the etchant is pumped into a holding or crystallization tank where it is kept at room temperature for several hours to crystallize out, i.e., precipitate, copper sulfate, usually as copper sulfate pentahydrate ($CuSO_4.5H_2O$), dissolved during operation. Following crystallization or precipitation of the copper, the etchant is put back into operation after proper adjustment of the levels of hydrogen peroxide, sulfuric acid and other stabilizers, defoamers, etc. Examples of suitable stabilizers, defoamers, inhibitors and the like which may be used are disclosed in U.S. Pat. Nos. 3,293,093, 4,110,237, 4,130,455, 4,140,646, 4,144,119, 4,158,592, 4,158,593 and 4,174,253, and the disclosures of these patents are incorporated herein by reference. Any one or some suitable, desired combination of these additives may be provided in the etchant, depending upon the desired function.

The amount of copper which may be removed during crystallization is limited by the difference between solubility of the copper in the aqueous hydrogen peroxide-sulfuric acid etchant at the operating temperature (110°-130° F.), and the solubility at the precipitation temperature (generally room temperature, or about 70° F.). Normally, the concentration of sulfuric acid in the etchant is maintained at a substantially constant level during use of the etchant, as for example about 14 or 15% by volume, and the etchant is operated until it approaches saturation. The etchant is then removed from operation and pumped into a holding tank, as noted previously, to precipitate out the copper sulfate by cooling of the solution. Usually, economic considerations dictate that the cooling of the solution is accomplished simply by allowing the solution to stand at ambient conditions. Refrigeration or other active cooling steps to precipitate out additional copper, then reheating to operating temperature, are usually not economically practical. In accordance with the prior art methods, a quantity of dissolved copper metal will precipitate out of the solution, and thereafter, the hydrogen peroxide, sulfuric acid and any other additives are replenished and the solution put back into operation.

The difficulty with the prior art methods discussed above is that the etchant must be frequently removed from operation at relatively short intervals to precipitate out the copper. This results in substantial down time for the etchant and increased handling and cost.

SUMMARY OF THE INVENTION

In accordance with the invention, it has been found that the solubility difference, i.e., the difference in solubility of copper in the etchant at operating temperature and at room temperature, respectively, can be substantially increased to increase the amount of copper precipitated out of the etchant during the crystallization step, while at the same time obtaining a good etch of the metal. Hence, by using the process according to the invention, the etchant may be used for significantly longer periods of time before crystallization of dissolved copper is required and greater amounts of copper may be recovered at each crystallization step.

According to the process of the invention, an aqueous etching solution containing predetermined amounts of $H_2O_2$, $H_2SO_4$ and water is used to etch metal from work pieces. During use of the etching solution, the concentration of $H_2SO_4$ is permitted to decrease to a predetermined low level and the etching solution is used until a predetermined concentration of dissolved metal in the etching solution is reached. The etching solution is then removed from use and $H_2SO_4$ is added to the etching solution to increase the $H_2SO_4$ to a predetermined high level. The dissolved metal is precipitated out of the etching solution, and thereafter, the etching solution is returned to use without further addition of $H_2SO_4$ and again used to etch metal while permitting the concentration of $H_2SO_4$ to decrease to the predetermined low level during use. If necessary, $H_2SO_4$ is added to the etching solution during use to maintain the concentration of $H_2SO_4$ at or near the predetermined low level.

More specifically, according to the process of the invention, a hydrogen peroxide-sulfuric acid solution is made, comprising: about 5-35% by volume of sulfuric acid; about 5% by volume of a suitable additive or additives, such as stabilizer, inhibitor, defoamer, etc.; about 2-4% by volume of a 50% hydrogen peroxide solution; and the balance water. The solution is heated to 110°-130° F. and operated to achieve the desired etch of copper clad circuit boards. The solution is operated or used until a predetermined concentration of copper in the solution is reached, usually about 65-70 g/l of copper metal. During operation, the concentrations of $H_2O_2$ and any additives are maintained, while the concentration of sulfuric acid is allowed to fall or decrease during the use of the solution to about 5–10% by volume, thereby increasing the solubility of the copper sulfate in the solution. When the predetermined concentration of copper in the solution is reached or approached, i.e., approximately 65–70 g/l of copper metal, the solution is transferred to a copper sulfate recovery tank. The solution is permitted to cool and sulfuric acid added to the solution to increase the concentration of acid to about 20–35% by volume, thereby decreasing the solubility of copper in the solution and permitting a more complete recovery of the copper sulfate. When the solution is put back into operation or use, hydrogen peroxide and desired additives are replenished but no acid replenishment is made. Thereafter, the sulfuric acid level is again permitted to drop during operation to a concentration of about 5–10% by volume, allowing more copper to dissolve before the predetermined concentration of metal in the solution is reached and the solution again removed from use for precipitation of metal therefrom.

Therefore, it is seen that the initial or high level of sulfuric acid (20–35 percent by volume) is permitted to decrease during the etching step to a low level (about 5–10 percent by volume) which is not more than about one-half of the predetermined high level.

It is believed that the prior art does not appreciate that one can operate successfully a hydrogen peroxide-sulfuric acid etchant over such a wide range of acid concentration. For example, it would be expected that the greater copper content at the low acid level would prevent a good etch from being obtained. In other words, although a suitably high etch rate can be obtained at the higher concentration of copper and low concentration of acid, it would be expected that under these conditions the copper etch would have a "polished" rather than a "rough" finish. However, it has been discovered by applicant that a predictable etch, with a good etch rate and microscopically "rough" surface, is obtained when operating according to the method of the present invention and a substantial amount of additional copper can be precipitated out of the solution.

Therefore, it is a principal object of the present invention to provide an improved metal dissolution process using $H_2O_2$—$H_2SO_4$ etchant.

A further object of the invention is to provide an improved process for operating a $H_2O_2$—$H_2SO_4$ etchant in which the concentration of $H_2SO_4$ in the etchant is permitted to decrease during use of the etchant from an initial, relatively high level when the etchant is put into use, to a final, relatively low level when a predetermined concentration of metal dissolved in the etchant is reached, thereby increasing the amount of metal removed from the etchant.

Another object of the invention is to provide an improved process of operating a $H_2O_2$—$H_2SO_4$ etchant in the processing of printed circuit boards or the like, wherein the concentration of $H_2SO_4$ in the etchant is allowed to decrease during operation of the etchant from an initial, relatively high level, to a final, relatively low level, thus increasing the difference in solubility of copper in the etchant at start up and removal of the etchant from operation, respectively.

BRIEF DESCRIPTION OF THE DRAWINGS

FIG. 1 is a graphic representation of the amount of copper dissolved at various temperatures for various concentrations of sulfuric acid in the solution.

DETAILED DESCRIPTION OF THE PREFERRED EMBODIMENTS

In accordance with the present invention, a novel method of operating a $H_2O_2$—$H_2SO_4$ etchant is disclosed.

The etchant used in the method of the invention comprises predetermined amounts of hydrogen peroxide, sulfuric acid, one or more additives for controlling foaming, stabilization and the like (if desired), and water.

The process of the invention is particularly suited for the etching of copper in the processing of printed circuit boards. During use of the etchant, the concentration of $H_2SO_4$ in the etching solution is allowed to decrease from an initial, relatively high level at the time the etch solution is put into use, to a final, relatively low level. When a predetermined concentration of dissolved etched metal exists in the etching solution, the etching solution is removed from use, $H_2SO_4$ is added to increase the concentration of $H_2SO_4$ in the etching solution to approximately the initial, relatively high level, and the metal is precipitated out of the etching solution. Thereafter, the etching solution is returned to use without further addition of $H_2SO_4$ and again used to etch metal while permitting the concentration of $H_2SO_4$ to decrease during use.

More specifically, the etchant used in the method of the invention is made up of about 5–35%, and preferably 10–20%, by volume, 66° Baume, tech. sulfuric acid; about 5% by volume of a suitable additive or additives, such as Enplate E 2743 A, manufactured by Enthone, Incorporated, of West Haven, Conn., or other suitable, commercially available additives; about 2–4% by volume of a commercially available 50% peroxide solution; and the balance water. Enplate E 2743 B, manufactured by Enthone, Incorporated, includes properly stabilized 50% peroxide solution.

In making up the solution, the etch tank is filled approximately two-thirds full with tap water and the sulfuric acid is then slowly stirred into the water. The bath is allowed to cool to below 130° F. and five gallons of the additive, such as Enplate E 2743 A, are added for every 100 gallons of tank solution. Two to four gallons of the peroxide solution are then added for every 100 gallons of tank solution, depending upon the desired etch rate. The etch tank is then filled to its full level with water and heated to operating temperature, i.e., 110°–130° F.

The additives placed in the solution may comprise commercially available materials, such as any of the well known stabilizers used for counteracting heavy metal ion-induced degradation of hydrogen peroxide. Examples of suitable stabilizers include those disclosed in U.S. Pat. Nos. 3,537,895, 3,597,290, 3,649,194, 3,801,512 and 3,945,865. These patents are incorporated in the present specification by reference. Of course, any of various other compounds having a stabilizing effect on acidified hydrogen peroxide metal treating solutions can be used with equal advantage.

Also, any of the additives known to prevent undercutting, i.e., side or lateral etching, can also be added, if desired. Examples of such compounds are the nitrogen compounds disclosed in U.S. Pat. Nos. 3,587,290 and 3,773,577, both of which are incorporated in this disclosure by reference.

Moreover, the additive or additives may include a suitable defoamer. Enplate E 2743 A, made by Enthone, Incorporated, for example, includes a defoamer and may be used in the etchant in the process of the present invention.

The use of such additives is not necessary to the operation of the invention, but may be desired in order to prevent the various conditions or occurrences for which the additives are designed as more fully disclosed in the referenced patents.

In operation of the invention, the concentration of sulfuric acid in the solution is allowed to fall to a specified level during operation to increase the solubility of the copper sulfate and hence the operating life of the bath. For example, the specified level may be about 10%, and if the concentration of the sulfuric acid falls below about 10% by volume, the required amount of 66° Baume $H_2SO_4$ should be added to restore the level to about 10%.

Under normal operating conditions, with an etch rate of 80–100 microinches over a 5 minute period, approximately 0.2 gallons of Enplate E 2743 A will be consumed for every 1000 square feet of work processed. Similarly, approximately 1.2 gallons of Enplate E 2743 B will be consumed for every 1000 square feet of work processed.

To raise the concentration of Enplate E 2743 A, add 0.25% Enplate E 2743 A for every 1% $H_2SO_4$ lost during operation; and to raise the concentration of Enplate E 2743 B by 1%, add 1 gallon of Enplate E 2743 B for every 100 gallons of tank solution.

Approach to saturation of the etchant with copper metal can be detected by removing a treated work from the etchant and observing any copper which crystallizes on the work after it is removed from the etchant.

With reference to FIG. 1, it can be seen that substantially greater amounts of copper are dissolved in the solution at saturation at lower levels of sulfuric acid concentration, for a given temperature.

The following examples are provided as specific illustrations of the invention.

EXAMPLES 1 AND 2

Etching tests were carried out in 1 liter baths with $H_2O_2$—$H_2SO_4$ etchants. Over a period of approximately 1½ days, several identical sized copper laminate coupons having a fiber-glass/epoxy substrate 1/18 of an inch thick and covered on both sides by a copper foil 1.4 thousandths of an inch thick were immersed in the baths and processed for 5 minutes each, while the baths were maintained at a temperature of 120° F.

The control etch solution (Example 1) as made up contained 15% by volume of 66° Baume sulfuric acid, 5% by volume of a 10% solution (½ g/l in the etching solution) of resorcinol disulphonic acid, 4% by volume of a commercially available 50% peroxide solution (Enplate E 2743 B), and the balance tap water.

The control etch solution (Example 1) was operated until it approached saturation of the etchant with copper, determined by observing copper crystals on the coupons when they were removed from the bath and cooled to room temperature. The concentration of copper in the solution under the foregoing condition was analytically determined to be 73 g/l copper metal (292 $CuSO_4.5H_2O$ at 120° F.), by using 1 ml pipette heated to about 120° F. to place 1 ml of the operating solution into a 500 ml Erlenmeyer flask and adding 2 ml of ammonium hydroxide solution. 100 ml of deionized water and 4 drops of PAN indicator were added and the mixture titrated with 0.0575 M EDTA (disodium ethylene diamine-tetra-acetate) solution from a blue color to a green end point. The PAN indicator was prepared by dissolving 0.1 gram 1-(2-pyridylazo)-2-naphtol PAN indicator in 100 ml of methanol; and the EDTA solution was prepared by dissolving 21.4 grams of EDTA and 6.0 grams of AR grade sodium hydroxide in deionized or distilled water. This mixture was allowed to cool and was then diluted to exactly one liter with deionized or distilled water.

The concentration of hydrogen peroxide in the solution was determined by using a 1 ml pipette to place 1 ml of the operating solution into a 500 ml Erlenmeyer flask. 200 ml of deionized water and 5 ml of 50% AR grade $H_2SO_4$ solution were then added and the flask swirled to mix thoroughly. Five to six drops of ferroin indicator solution were then added and the mixture titrated with 0.1 N $Ce(SO_4)_2$ solution from a pale orange color to a pale blue color. The percent by volume of the peroxide solution in the bath was then determined by multiplying the milliliters of $Ce(SO_4)_2$ titrated times the Normality $Ce(SO_4)_2$ times 2.84. Hydrogen peroxide was replenished at the rate of 4.5 ml per square foot of work processed, and for every 10 ml of $H_2O_2$ added, 0.1 gram of resorcinol disulphonic acid was added.

The etchant was allowed to cool overnight to 63° F. and the copper metal again analyzed as above. The concentration of copper metal at this time was found to be 41 g/l copper metal (164 g/l $CuSO_4.5H_2O$). The sulfuric acid was also analyzed when the etchant was placed to cool, and it was found that the acid concentration had decreased to 12% by volume. Analysis for the acid was made by using a 2 ml pipette to place 2 ml of the operating etch solution into a 250 ml Erlenmeyer flask and adding 100 ml of deionized water. Two to three drops of methyl orange indicator solution were then added to the flask and titrated with 1.0 N NaOH solution to a bright yellow end point. The percent by volume of the 66° Baume sulfuric acid was then determined by the following calculation: ml NaOH titrated x Normality NaOH $\times 1.42 =$ % by volume $H_2SO_4$ Baume.

Example 2 was made up exactly as Example 1, and was operated exactly the same, except no sulfuric acid was added to the bath following initial make up. When the etchant in Example 2 approached saturation, determined as in Example 1, it was analyzed for copper and sulfuric acid just as done in Example 1. At 120° F., the copper metal concentration was found to be 112 g/l (449 g/l $CuSO_4.5H_2O$) and the sulfuric acid concentration was found to be 8.2% by volume. Sulfuric acid was then added to bring the concentration up to 19.6% by volume and the solution was allowed to sit overnight at 63° F., precipitating out copper sulfate. Analysis for copper was again made and it was determined that 21 g/l copper metal (84 g/l $CuSO_4.5H_2O$) remained in the bath. In accordance with Example 1, only 32 g/l copper metal was precipitated out, leaving 41 g/l in solution; while in accordance with Example 2, 91 g/l copper metal was precipitated out, leaving only 21 g/l in solution.

Thus, permitting the sulfuric acid concentration to decrease to approximately 8% by volume during operation of the etchant in Example 2, and then increasing the sulfuric acid concentration to approximately 20% by volume when the etchant was removed from use to precipitate out the copper, resulted in a dramatic increase in the amount of copper recovered.

Moreover, the different solubility levels of copper achieved by varying the sulfuric acid concentration in accordance with the invention enabled the etchant to be operated nearly twice as long before it was necessary to precipitate out the copper.

Coupons treated or processed in accordance with both Examples 1 and 2 were subjected to electroless copper deposition in accordance with well known techniques, and adhesion of the copper deposit was tested in a known manner by using adhesive tapes provided for this purpose. None of the coupons failed the adhesion test, thus indicating that a good etch was obtained with both procedures.

While the invention has been particularly described herein as for use in providing a microscopically rough finish to copper cladding on circuit boards for subsequent electroless deposition of copper on the copper clad, it should be recognized that the invention is equally applicable to use in etching away copper metal from printed circuit boards in the formation of the printed circuits on the boards.

Although the invention has been described and illustrated in detail, it is to be understood that the novel and improved method of the invention may be altered, varied, or modified without departing from the spirit and scope of the invention as defined in the appended claims.

What is claimed is:

1. In a process for dissolving a metal by etching with an aqueous solution, wherein the aqueous etching solution includes initial predetermined high levels of of $H_2O_2$ and $H_2SO_4$ in water, the improvement comprising:

etching the metal from work pieces with the etching solution while permitting the concentration of $H_2SO_4$ in the etching solution to decrease from its high level to a predetermined low level which is not more than about one-half of the predetermined high level, and until the concentration of etched metal dissolved in the etching solution reaches a predetermined level;

removing the etching solution from use;

adding $H_2SO_4$ to the etching solution to increase the $H_2SO_4$ concentration to the predetermined high level;

allowing the metal dissolved in the etching solution to precipitate out of the etching solution, and recycling the metal-depleted etching solution to the etching step.

2. A process for dissolving metal as defined in claim 1, including the step of:

replenishing the hydrogen peroxide in the solution during the etching step as needed to maintain the concentration thereof at or near its predetermined high level.

3. A process for dissolving a metal as defined in claim 2, wherein:

the solution includes at least one additive and including the step of replenishing the additive during the etching step.

4. A process for dissolving a metal as defined in claim 2, including the step of:

maintaining the concentration of $H_2SO_4$ in the etching solution at or near the predetermined low level by replenishing the $H_2SO_4$ in the etching solution from time to time during the etching step until the concentration of dissolved metal in the etching solution reaches its' predetermined level.

5. A process for dissolving a metal as defined in claim 4, wherein:

the initial high levels of $H_2O_2$ and $H_2SO_4$ in the etching solution are about 5–35% by volume $H_2SO_4$, about 2–4% by volume of a 50% $H_2O_2$ solution, in water.

6. A process for dissolving a metal as defined in claim 5, wherein:

the metal etched is copper, and the initial high level of $H_2SO_4$ is from about 10% to about 20% by volume.

7. A process for dissolving a metal as defined in claim 6, wherein:

the concentration of $H_2SO_4$ is maintained at about the predetermined low level until the concentration of copper in the solution reaches about 60–112 g/l as its predetermined level.

8. A process for dissolving a metal as defined in claim 7, wherein:

the etchant is removed from operation and is cooled to about 70° F. to precipitate out copper when the concentration of copper in the solution reaches about 60–112 g/l.

* * * * *